US010886056B2

(12) United States Patent
Yamashita et al.

(10) Patent No.: US 10,886,056 B2
(45) Date of Patent: Jan. 5, 2021

(54) INDUCTOR ELEMENT

(71) Applicant: TDK CORPORATION, Tokyo (JP)

(72) Inventors: Yasuhide Yamashita, Tokyo (JP); Katsushi Yasuhara, Tokyo (JP); Chiomi Sato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 277 days.

(21) Appl. No.: 15/967,769

(22) Filed: May 1, 2018

(65) Prior Publication Data

US 2018/0322997 A1 Nov. 8, 2018

(30) Foreign Application Priority Data

May 2, 2017 (JP) ..... 2017-091666

(51) Int. Cl.

| | |
|---|---|
| ***H01F 27/255*** | (2006.01) |
| ***H01F 3/08*** | (2006.01) |
| ***H01F 27/28*** | (2006.01) |
| ***H01F 3/10*** | (2006.01) |
| ***H01F 17/04*** | (2006.01) |
| *H01F 27/02* | (2006.01) |

(52) U.S. Cl.

CPC ..... *H01F 27/255* (2013.01); *H01F 3/08* (2013.01); *H01F 3/10* (2013.01); *H01F 17/043* (2013.01); *H01F 27/2823* (2013.01); *H01F 27/02* (2013.01); *H01F 2003/106* (2013.01)

(58) Field of Classification Search

CPC ..... H01F 27/255; H01F 3/08

See application file for complete search history.

(56) References Cited

U.S. PATENT DOCUMENTS

| | | | | |
|---|---|---|---|---|
| 10,115,518 | B2 * | 10/2018 | Jeong | H01F 27/292 |
| 10,643,785 | B2 * | 5/2020 | Yang | H01F 17/04 |
| 2003/0048167 | A1 * | 3/2003 | Inoue | H01F 17/04 336/200 |
| 2004/0046626 | A1 * | 3/2004 | Nakata | H01F 17/043 336/83 |

(Continued)

FOREIGN PATENT DOCUMENTS

JP 2002-252120 A 9/2002

*Primary Examiner* — Elvin G Enad
*Assistant Examiner* — Malcolm Barnes
(74) *Attorney, Agent, or Firm* — Oliff PLC

(57) ABSTRACT

An inductor element includes a wire-winding portion and a core portion. In the wire-winding portion, a conductor is wound in a coil shape. The core portion surrounds the wire-winding portion and contains a magnetic powder and a resin. The wire-winding portion includes an inner circumferential surface. A winding-wire inner circumferential neighboring region is a region of the core portion within a distance from the inner circumferential surface toward a winding axis of the wire-winding portion. An inner-core central region is a region of the core portion within a distance from the winding axis center toward an existing region of the wire-winding portion in an outward direction perpendicular to the winding axis center. $S\alpha - S\beta1 \geq 5.0\%$ is satisfied, where $S\alpha(\%)$ and $S\beta1(\%)$ are respectively an area ratio of a magnetic powder in the inner-core central region and the winding-wire inner circumferential neighboring region.

19 Claims, 15 Drawing Sheets

(56) References Cited

U.S. PATENT DOCUMENTS

| | | | | |
|---|---|---|---|---|
| 2010/0194511 | A1* | 8/2010 | Kobayashi | H01F 41/0246 336/83 |
| 2012/0105188 | A1* | 5/2012 | Lim | H01F 27/245 336/200 |
| 2012/0274433 | A1* | 11/2012 | Matsumoto | H01F 27/292 336/192 |
| 2014/0097927 | A1* | 4/2014 | Yamamoto | H01F 27/255 336/200 |
| 2014/0184374 | A1* | 7/2014 | Park | H01F 17/0013 |
| 2016/0042859 | A1* | 2/2016 | Park | H01F 17/04 336/200 |
| 2016/0181002 | A1* | 6/2016 | Kim | H01F 17/0013 336/200 |
| 2016/0276088 | A1* | 9/2016 | Kwon | H01F 41/0246 |
| 2016/0293319 | A1* | 10/2016 | Hong | H01F 17/04 |
| 2016/0343486 | A1* | 11/2016 | Kim | H01F 41/0246 |
| 2017/0301451 | A1* | 10/2017 | Kim | H01F 41/061 |
| 2018/0182531 | A1* | 6/2018 | Muneuchi | H01F 27/2828 |
| 2018/0308609 | A1* | 10/2018 | Shinohara | H01F 41/10 |

* cited by examiner

INDUCTOR ELEMENT

BACKGROUND OF THE INVENTION

1. Field of the Invention

The present invention relates to an inductor element.

2. Description of the Related Art

As an example of inductor elements, known is an inductor element where a coil is embedded in a core obtained by adding a resin to a metal magnetic powder and molding it with pressure.

Patent Document 1 below discloses a method of manufacturing a coil device where a magnetic powder and a thermosetting resin are mixed and molded with pressure so as to form two pressed powders, and the pressed powders are re-pressed while sandwiching a coil portion and are thermosetted. When the pressed powders are molded with the re-pressing, there are provided with a large-hardness part where the shape of the pressed powders does not collapse and a small-hardness part where the shape of the pressed powders collapses, and the pressed powders are molded while the small-hardness part is being collapsed by the re-pressing.

In the technique of Patent Document 1, however, the molding needs to be carried out by collapsing a part of the pressed powders and re-pressing it. In recent years, as the current of coil devices has been increased, DC superposition characteristics of coils need to be improved. To improve DC superposition characteristics, density needs to be increased.

In addition, since the shape of the small-hardness part collapses easily during the molding with re-pressing, a sufficient pressure transmission cannot be achieved, and the density of a part where the pressed powders are joined decreases particularly. That is, the density of the core easily becomes uneven in an inductor element obtained finally. Furthermore, if a pressure during the re-pressing is high for increasing the density, a coil film is broken or an inner wall of a die and the surface of the magnetic powder are rubbed, and withstand voltage decreases easily.

Patent Document 1: JP 2002-252120 A

SUMMARY OF THE INVENTION

The present invention has been achieved under such circumstances. It is an object of the invention to provide an inductor element that is less prone to cracks during use.

To achieve the above object, an inductor element according to the present invention comprises:

a wire-winding portion where a conductor is wound in a coil shape; and a core portion surrounding the wire-winding portion and containing a magnetic powder and a resin, wherein the wire-winding portion comprises an inner circumferential surface, an outer circumferential surface, and a first end surface and a second end surface opposite to each other in a winding axis center of the wire-winding portion, wherein a winding-wire inner circumferential neighboring region is defined as a region of the core portion within a predetermined distance from the inner circumferential surface toward the winding axis center, wherein a winding-wire first end-surface neighboring region is defined as a region of the core portion within a predetermined distance from the first end surface toward an outward direction parallel to the winding axis center, wherein a winding-wire second end-surface neighboring region is defined as a region of the core portion within a predetermined distance from the second end surface toward the outward direction, wherein an inner-core central region is defined as a region of the core portion within a predetermined distance from the winding axis center toward an existing region of the wire-winding portion in an outward direction perpendicular to the winding axis center, and wherein $S\alpha - S\beta 1 \geq 5.0\%$ is satisfied, where $S\alpha(\%)$ is an area ratio of a magnetic powder in the inner-core central region, and $S\beta 1(\%)$ is an area ratio of the magnetic powder in the winding-wire inner circumferential neighboring region.

The inductor element according to the present invention has the above structure, and can thereby prevent generation of cracks during use.

Moreover, $S\alpha - S\beta 4 \geq -2.0\%$ is preferably satisfied, where $S\alpha(\%)$ is an area ratio of the magnetic powder in the inner-core central region, and $S\beta 4(\%)$ is an average of $S\beta 2$ and $S\beta 3$, where $S\beta 2(\%)$ is an area ratio of the magnetic powder in the first end-surface neighboring region, and $S\beta 33(\%)$ is an area ratio of the magnetic powder in the second end-surface neighboring region, on a cross section of the inductor element passing the winding axis center and parallel thereto.

Moreover, $S\alpha - S\beta 4 \geq 0\%$ is preferably satisfied.

Moreover, $S\alpha - S\beta 4 \geq 5.0\%$ is preferably satisfied.

Moreover, $S\alpha \geq 65\%$ is preferably satisfied.

Moreover, $S\beta 1 \geq 60\%$ is preferably satisfied.

Moreover, $S\beta 4 \geq 60\%$ is preferably satisfied.

DETAILED DESCRIPTION OF THE PREFERRED EMBODIMENT

Hereinafter, the present invention is described based on embodiments shown in figures, but is not limited to the following embodiments.

First Embodiment

Figure 1:
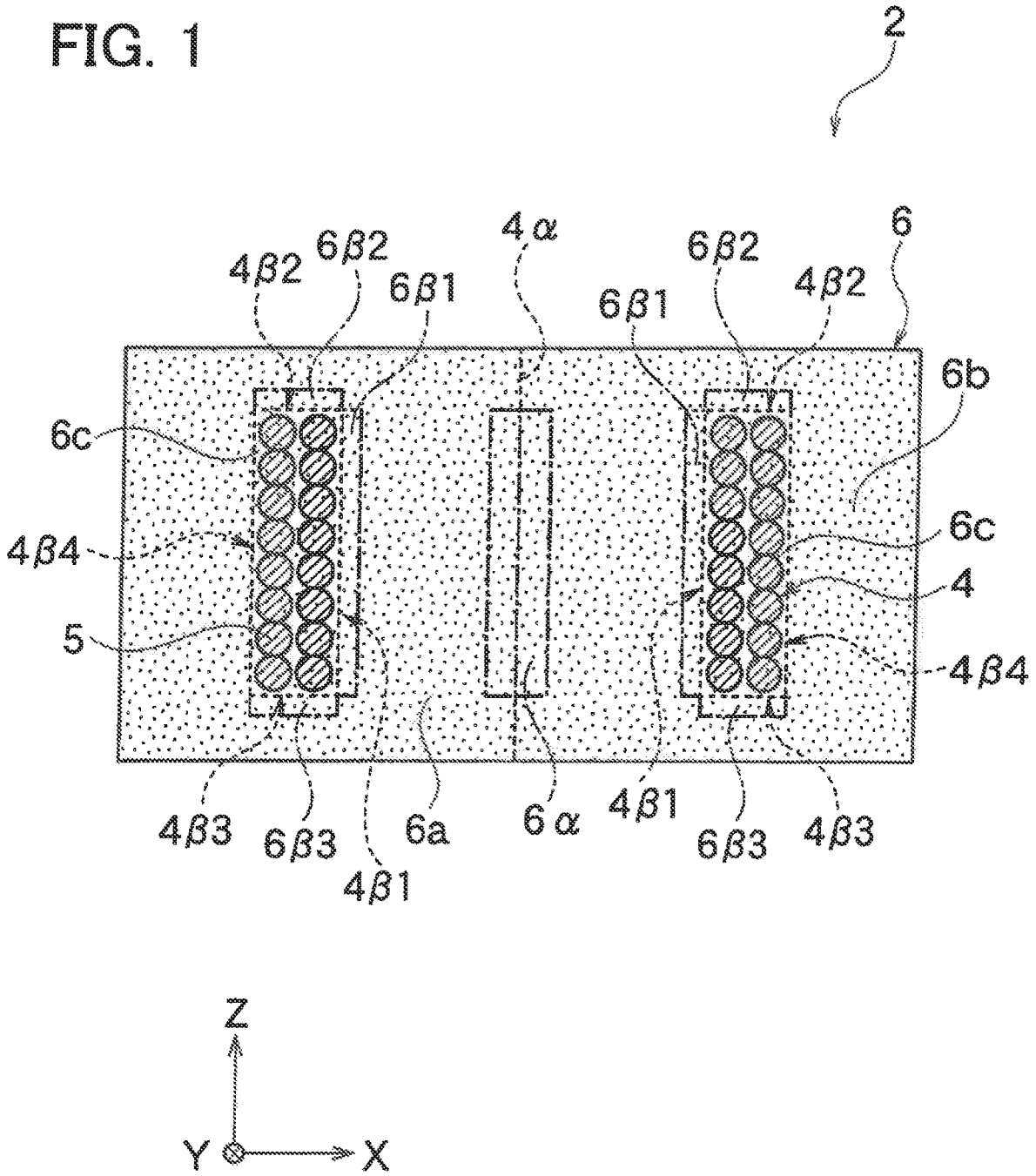
FIG. 1 is a cross-sectional view of an inductor element according to First Embodiment of the present invention.

FIG. 1 is a cross sectional view passing a winding axis center 4*a* of a winding-wire portion 4 mentioned below and being parallel to the winding axis center 4*a*. As shown in FIG. 1, an inductor element 2 according to an embodiment of the present invention includes the winding-wire portion 4 and a core portion 6. In the winding-wire portion 4, a conductor 5 is wound in a coil shape. The core portion 6 includes an inner circumferential part (also referred to as an inner core part) 6*a* on the inner circumferential side of the winding-wire portion 4 and an outer circumferential part 6*b* on the outer circumferential side of the winding-wire portion 4. A magnetic powder and a resin constituting the core portion 6 are inserted into a space 6*c* between the core portion 6 and the conductor 5 constituting the winding-wire portion 4.

The winding-wire portion 4 includes an inner circumferential surface 4β1, an outer circumferential surface 4β4, and a first end surface 4β2 and a second end surface 4β3 arranged opposite to each other in the winding axis center 4α.

In the inductor element 2 of the present embodiment, the top and bottom surfaces of the core portion 6 are substantially perpendicular to the Z-axis, and the side surface of the core 6 is substantially perpendicular to a plane including the X-axis and the Y-axis. The winding axis of the winding-wire portion 4 is substantially parallel to the Z-axis. The shape of the core portion 6 is not limited to the shape of FIG. 1 and may be cylinder, elliptic cylinder, etc.

The inductor element 2 of the present embodiment has any size, and for example has a size where the part excluding lead portions 5*a* and 5*b* is contained in a cuboid or cube of (2 to 17) mm×(2 to 17) mm×(1 to 7) mm. Incidentally, FIG. 1 does not illustrate the lead portions 5*a* or 5*b* of the winding-wire portion 4 shown in FIG. 2. The lead portions 5*a* and 5*b* formed on both ends of the conductor 5 constituting the winding-wire portion 4 are configured to be taken outside the core portion 6 shown in FIG. 1.

The outer circumference of the conductor (conductive wire) 5 constituting the winding-wire portion 4 is covered with an insulating film as necessary. For example, the conductor 5 is composed of Cu, Al, Fe, Ag, Au, or an alloy containing these metals. For example, the insulating film is composed of polyurethane, polyamide imide, polyimide, polyester, polyester-imide, or polyester-nylon. The conductor 5 has any transverse planar shape, such as circle and rectangle. In the present embodiment, the conductor 5 has a circular transverse plane.

The core portion 6 has a magnetic powder and a resin (binder). The magnetic powder is not limited, and is a ferrite of Mn—Zn, Ni—Cu—Zn, etc. or a metal of Fe—Si (iron-silicon), sendust (Fe—Si—Al; iron-silicon-aluminum), Fe—Si—Cr (iron-silicon-chromium), permalloy (Fe—Ni), etc. Preferably, the magnetic powder is Fe—Si or Fe—Si—Cr. The magnetic has any crystal structure, such as amorphous and crystalline. The resin is not limited, and is an epoxy resin, a phenol resin, a polyimide, a polyamideimide, a silicone resin, a combination thereof, or the like.

The present embodiment is characterized in that the inside of the core portion 6 has a predetermined difference in density.

As shown in FIG. 1, the core portion 6 includes a winding-wire inner circumferential neighboring region 6β1, a first end-surface neighboring region 6β2, and a second end-surface neighboring region 6β3. The winding-wire inner circumferential neighboring region 6β1 is defined as a region within 100 μm from the inner circumferential surface 4β1 toward the winding axis center 4α. The first end-surface neighboring region 6β2 is defined as a region within 100 μm from the first end surface 4β2 toward the outside in the parallel direction to the winding axis center 4α. The second end-surface neighboring region 6β3 is defined as a region within 100 μm from the second end surface 4β3 toward the outside in the parallel direction to the winding axis center 4α. The winding-wire portion 4 is present in the outward direction perpendicular to the winding axis center 4α. The core portion 6 includes an inner-core central region 6α within 280 μm from the winding axis center 4α toward the outward direction perpendicular thereto.

In the inductor element 2 of the present embodiment, $S\alpha - S\beta 1 \geq 5.0\%$ is satisfied, where Sa (%) is an area ratio of the magnetic powder in the inner-core central region 6α, and Sβ1(%) is an area ratio of the magnetic powder in the winding-wire inner circumferential neighboring region 6β1. In the core portion 6, the density of the magnetic powder in the part close to the winding axis center 4α is thereby higher than that in the part close to the winding-wire 5. $S\alpha - S\beta 1$ may be 5.4% or more. $S\alpha - S\beta 1$ has no upper limit, but is normally 20% or less. $S\alpha - S\beta 1$ may be 7.5% or less.

When the density of the magnetic powder in the part close to the winding axis center 4α is higher than that in the part on the inner side of the winding-wire 5 and close thereto in the core portion 6, the inductor element of the present embodiment can prevent generation of cracks and further improve inductance and DC superposition characteristics.

In the inductor element 2 of the present embodiment, $S\alpha - S\beta 4 \geq -2.0\%$ is preferably satisfied, where Sβ2(%) is an area ratio of the magnetic powder in the first end-surface neighboring region 6β2, Sβ3(%) is an area ratio of the magnetic powder in the second end-surface neighboring region 6β3, and Sβ4(%) is an average of Sβ2 and Sβ33. $S\alpha - S\beta 4 \geq 0\%$ is more preferably satisfied. $S\alpha - S\beta 4 \geq 5.0\%$ is further more preferably satisfied. That is, it is preferred in the inductor element 2 of the present embodiment that the density of the magnetic powder close to the winding axis center 4α be equal to or more than the density of the magnetic powder close to the winding-wire 5 and above and below the winding-wire 5 in the Z-axis direction. This structure makes it easier to prevent generation of cracks and makes it possible to easily improve inductance and DC superposition characteristics.

In the inductor element 2 of the present embodiment, $S\alpha \geq 65\%$ is preferably satisfied. Moreover, $S\beta 1 \geq 60\%$ is preferably satisfied, and $S\beta 4 \geq 60\%$ is preferably satisfied. That is, the density of the magnetic powder is preferably a predetermined amount or more. When the magnetic powder has a high density, it becomes easier to prevent generation of cracks and improve inductance and DC superposition characteristics.

The area ratio of the magnetic powder is measured by any method. For example, the area ratio of the magnetic powder is calculated visually from a SEM image of a cross section of the inductor element. The SEM image is observed using a SU820 (manufactured by Hitachi High-Technologies Corporation). The image analysis software is a NanoHunter NS2K-Pro (manufactured by Nano System Co., Ltd.). When the area ratio is calculated from the SEM image, there is no limit to magnification or size of the SEM image. For example, the SEM image has a magnification of 100 to 180 times and a size of 480 μm×560 μm.

It can normally be considered that the area ratio of the magnetic powder is uniform in each of the regions. To reduce errors, it is normal that a plurality of measurement points is appropriately determined so as to be arranged substantially equally in each of the regions, and that used is an averaged result of measurement results of the area ratio of the magnetic powder at each of the measurement points. The number of measurement points is determined appropriately depending upon size, shape, etc. of each region. In the inner-core central region and the winding-wire inner circumferential neighboring region, for example, it is preferred that three or more measurement points (more preferably, five or more measurement points) be determined appropriately so as to be arranged substantially equally in each of the regions. Then, the measurement results at each of the measurement points are averaged and considered to be a measurement result of the region. In the first end-surface neighboring region and the second end-surface neighboring region, a measurement result at one measurement point may normally be considered to be a measurement result of the region.

Figure 2:
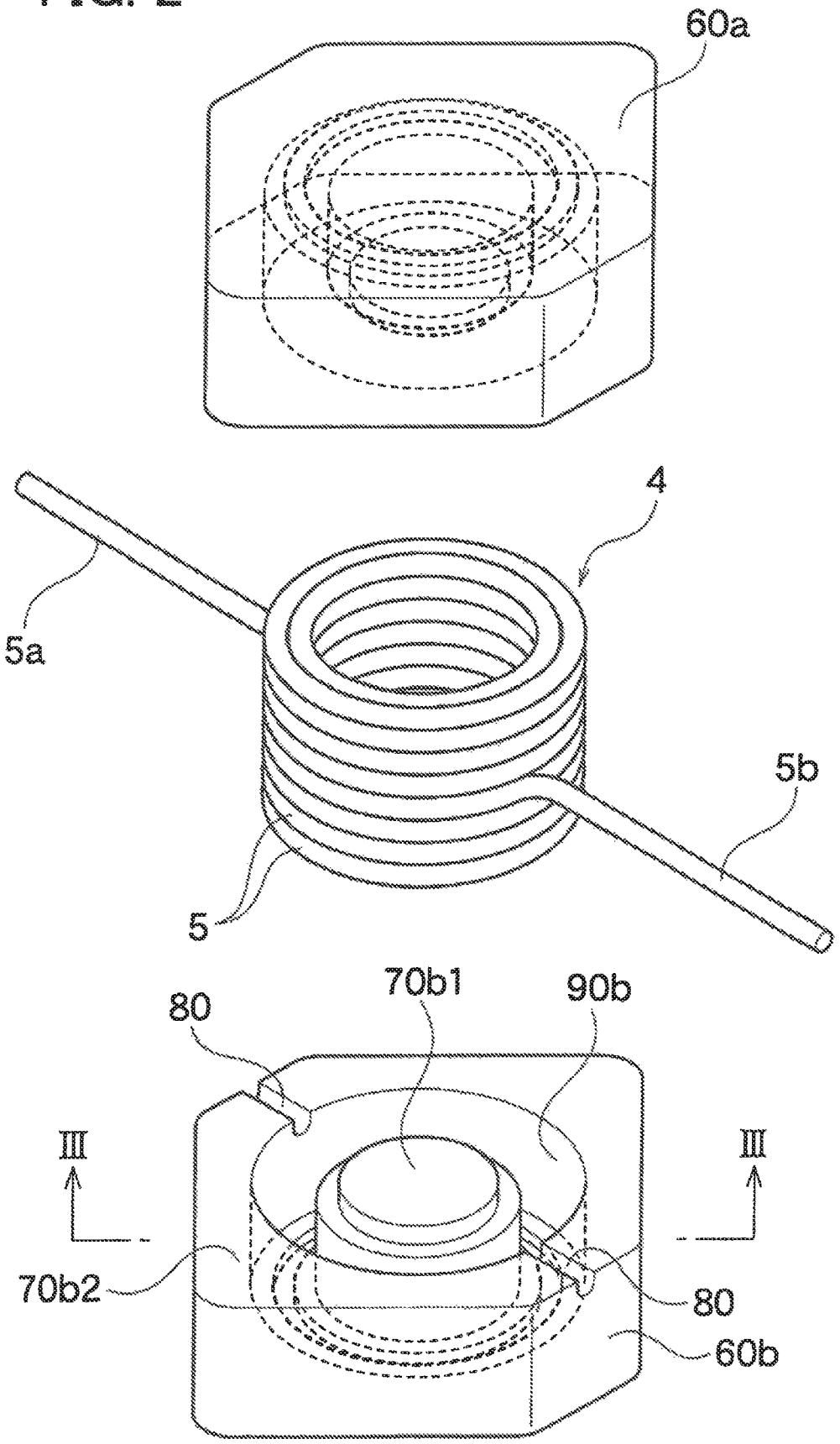
FIG. 2 is a perspective view showing a preliminary green compact and an insert member used in a manufacturing process of the inductor element shown in FIG. 1.
Figure 3:
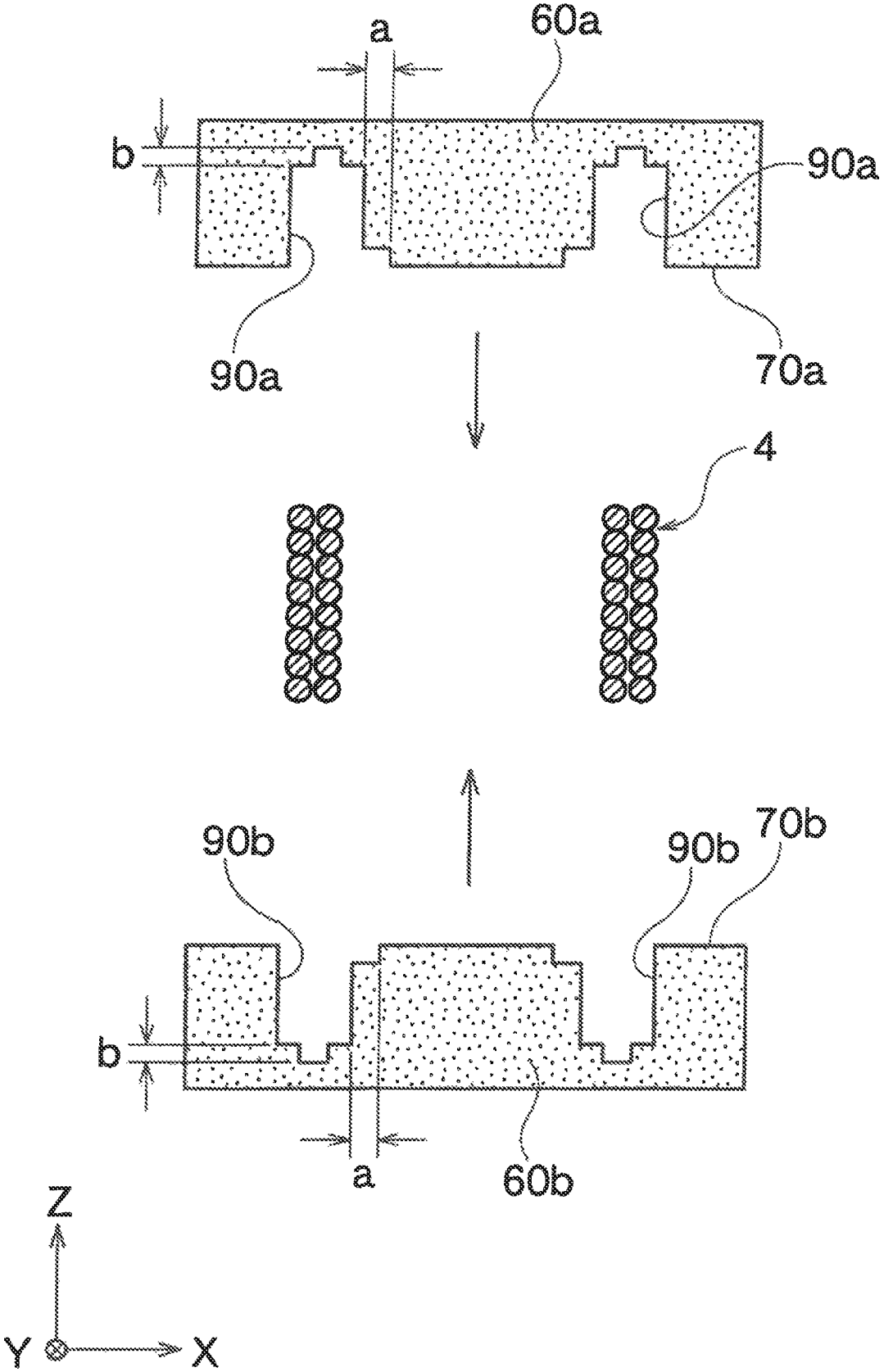
FIG. 3 is a cross-sectional view along the III-III line shown in FIG. 2.

Next, a method of manufacturing the inductor element 2 shown in FIG. 1 is described using FIG. 2 and FIG. 3.

The inductor element 2 manufactured by the method according to an embodiment of the present invention is manufactured by integrating two preliminary green compacts 60*a* and 60*b* and an insert member having the winding-wire portion 4 constituted by an air-core coil or so. Both ends of the conductor 5 constituting the winding-wire portion 4 are drawn as lead portions 5*a* and 5*b* toward outside the winding-wire portion 4. Terminals (not shown) may be connected with the lead portions 5*a* and 5*b* after a main compression or may previously be connected with the lead portions 5*a* and 5*b* before a main compression.

Joint projected surfaces 70*a* and 70*b* are respectively formed on the preliminary green compacts 60*a* and 60*b* and are configured to be abutted and joined with each other. The joint projected surfaces 70*a* and 70*b* respectively include housing concave portions 90*a* and 90*b* for housing an upper half and a lower half of the winding portion 4. The housing concave portions 90*a* and 90*b* have a size where inner and outer circumferences and ends of the winding portion 4 as an insert member in the winding axis direction can contact with and enter the housing concave portions 90*a* and 90*b*. The larger the housing concave portions 90*a* and 90*b* are, the smaller Sβ1, Sβ2, and/or Sβ3 tend(s) to be. This makes it easier to increase Sα−Sβ1, Sα−Sβ2, and/or Sα−Sβ3.

Moreover, the housing concave portions 90*a* and 90*b* may include a groove whose depth is "a" and a groove whose depth is "b" at the positions shown in FIG. 3. The grooves are to be removed by compression, but the density around the winding-wire portion 4 decreases by forming the grooves in the housing concave portions 90*a* and 90*b*. More specifically, the larger "a" is, the smaller Sβ1 tends to be, and the larger "b" is, the smaller Sβ2 and Sβ3 tend to be.

Either or both of the joint projected surfaces 70*a* and 70*b* includes(s) leading grooves 80 for leading the lead portions 5*a* and 5*b* to the outside of the core portion 6. Incidentally, FIG. 2 illustrates a pair of lead portions 5*a* and 5*b*, but FIG. 3 does not illustrate the pair of lead portions 5*a* and 5*b*.

First, prepared by any method are granules to be a raw material of the preliminary green compacts 60*a* and 60*b*. For example, the granules can be prepared by adding a resin to a magnetic powder and stirring and drying it.

The magnetic powder has any particle size. For example, the magnetic powder has an average particle size of 0.5 to 50 μm. Examples of the resin include epoxy resin, phenol resin, polyimide, polyamide imide, silicone resin, and a combination of them. An insulating film may be formed on the surface of the magnetic powder before mixing the magnetic powder and the resin. For example, an insulating film of $SiO_2$ film can be formed by sol-gel method.

Coarse granules may be removed by adding the resin to the magnetic powder, stirring it, and passing it through a mesh. The resin may be diluted with a solvent when added to the magnetic powder. The solvent is ketones, for example.

The amount of the resin is not limited, but is preferably 1.0 to 6.0 wt % with respect to 100 wt % of the magnetic powder. When the amount of the resin is appropriate, the joint projected surfaces 70*a* and 70*b* are easily joined during a main compression mentioned below. The larger the amount of the resin is, the smaller the density of the magnetic powder is, and the smaller Sa, Sβ1, Sβ2, and Sβ3 tend to be.

The preliminary green compacts 60*a* and 60*b* are manufactured in such a manner that the granules containing the magnetic powder and the resin are filled in a die cavity and compressed preliminarily. The preliminary compression is carried out at any pressure, but is preferably carried out at a pressure of $2.5\times10^2$ to $1\times10^3$ MPa (2.5 to 10 t/cm$^2$). The preliminary green compacts 60*a* and 60*b* have any density. For example, the preliminary green compacts 60*a* and 60*b* preferably have a density of 4.0 to 6.5 g/cm$^3$.

When the preliminary compression is carried out at a pressure of $2.5\times10^2$ to $1\times10^3$ MPa, prevented is/are a positional displacement of the winding portion 4 and/or a shape distortion of the wire generated after a main compression mentioned below, and it becomes easier to manufacture an inductor element excelling in all of withstand voltage, inductance, and DC superposition characteristics. When the densities of the preliminary green compacts 60*a* and 60*b* are in the above mentioned range (particularly 4.0 g/cm$^3$ or more), Sα, Sβ1, Sβ2, and Sβ3 mentioned above become high easily. When the densities of the preliminary green compacts 60*a* and 60*b* are 6.5 g/cm$^3$ or less, it becomes easier to maintain the rust preventive effect of the product. This is because if the preliminary compression is carried out at a pressure that is high enough to obtain a high-density preliminary green compact, the insulating film becomes easy to be peeled.

Next, the inductor element 2 is obtained by arranging the obtained preliminary green compacts 60*a* and 60*b* and insert member in another die cavity that is different from the die cavity in the manufacture of the preliminary green compacts 60*a* and 60*b* as shown in FIG. 2 and FIG. 3 and carrying out a main compression (crimping). The main compression is carried out at any pressure, but is preferably carried out, for example, at a pressure of $1\times10^2$ to $8\times10^2$ MPa (1 to 8 t/cm$^2$). The pressure during the main compression is lower than the pressure during the preliminary compression (100%). The pressure during the main compression is preferably about 40 to 80%, more preferably about 50 to 60%, of the pressure during the preliminary compression (100%).

When the pressure during the main compression is lower than the pressure during preliminary compression, it becomes easier to prevent a positional displacement of the winding portion 4 and/or a shape distortion of the wire generated after the main compression. The larger the pressure during the preliminary compression is than the pressure during the main compression, the more easily withstand voltage characteristics tend to improve.

Preferably, the resin is completely hardened by heating the inductor element 2 taken out from the die after the main compression. Specifically, the resin is preferably completely hardened by heating the inductor element 2, which has been taken out from the die, at a temperature that is higher than a temperature where the resin begins to be hardened.

In the inductor element 2 manufactured by the above-mentioned method, a positional displacement of the winding portion 4 and/or a shape distortion of the wire is/are small, and the core portion 6, particularly the inner-core central region 6α, can be formed densely. Thus, withstand voltage can also be improved while inductance and DC superposition characteristics are improved.

In the present embodiment, the core portion 6 of the inductor element 2 to be finally obtained can be manufactured uniformly and densely. As a result, inductance and DC superposition characteristics can be improved more than those of conventional inductor elements.

Figure 6:
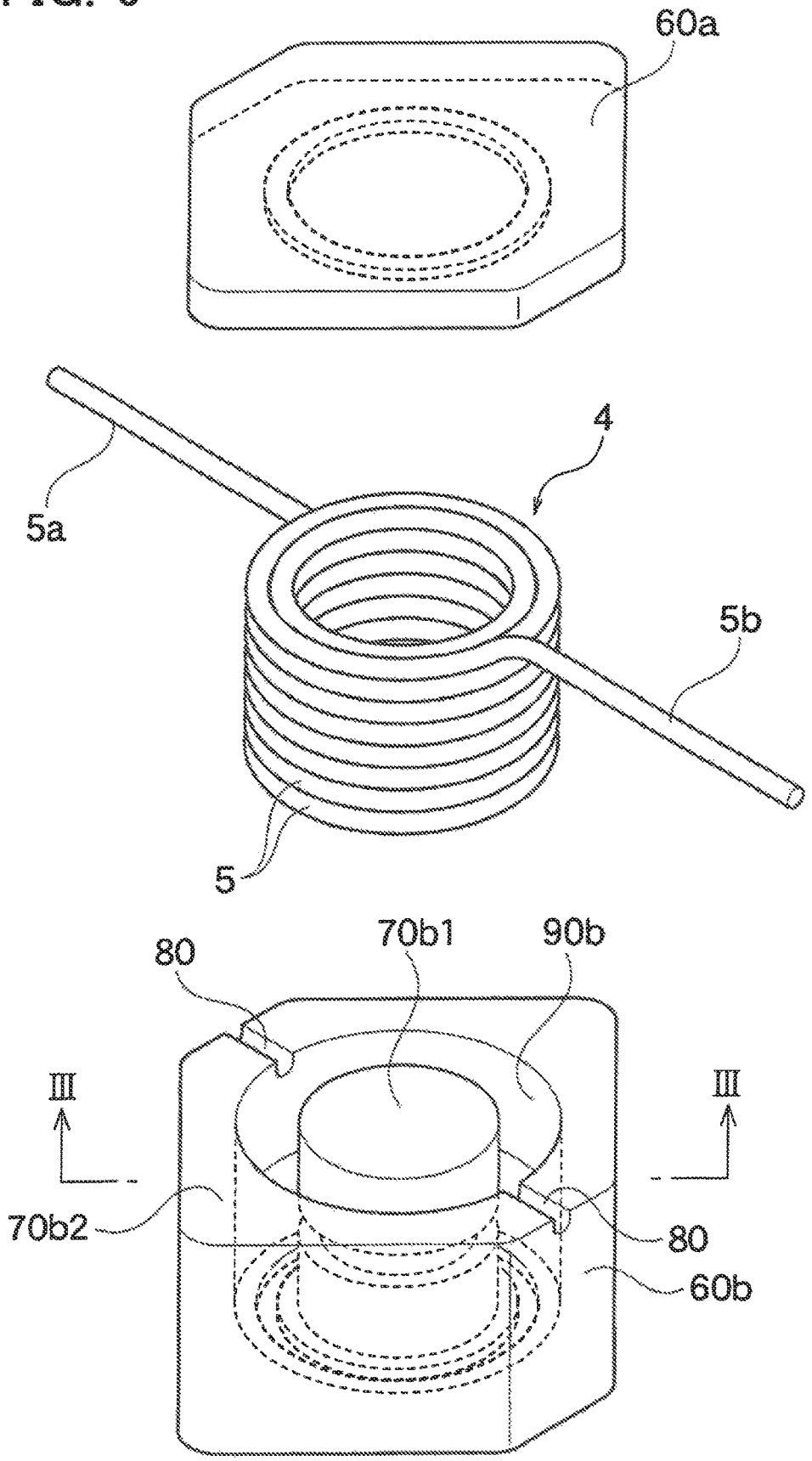
FIG. 6 is a perspective view showing a preliminary green compact and an insert member used in a manufacturing process of the inductor element shown in FIG. 1.
Figure 7:
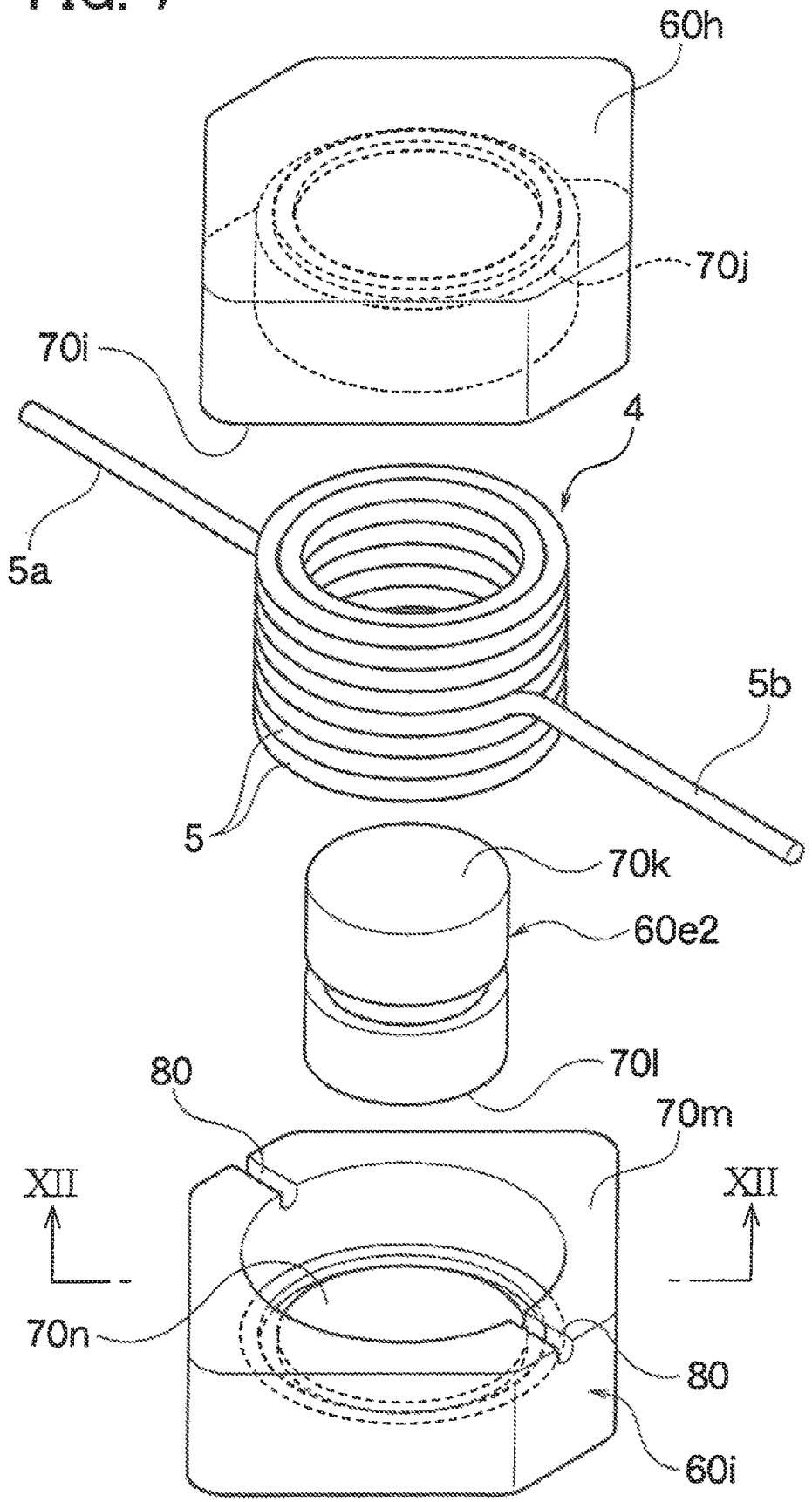
FIG. 7 is a perspective view showing a preliminary green compact and an insert member used in a manufacturing process of the inductor element shown in FIG. 1.

In addition to the method shown in FIG. 2 and FIG. 3, the inductor element 2 according to the present embodiment is manufactured by, for example, a method of preparing a flat preliminary green compact 60*a*1 and a pot preliminary green compact 60*b*1 as shown in FIG. 6. Incidentally, the preliminary green compacts 60*a*1 and 60*b*1 may include a groove whose depth is "a" and a groove whose depth is "b" similarly to the method shown in FIG. 2 and FIG. 3. Moreover, the inductor element 2 according to the present embodiment may be manufactured by preparing three preliminary green compacts 60*e*2, 60*h*, and 60*i* as shown in FIG. 7. The shapes of the preliminary green compacts are not limited to the shapes shown in FIG. 6 or FIG. 7, and should be determined so that the inductor element 2 to be finally obtained has the shape shown in FIG. 1. Incidentally, the preliminary green compacts 60*e*2, 60*h*, and 60*i* may include a groove whose depth is "a" and a groove whose depth is "b" similarly to the method shown in FIG. 2 and FIG. 3. The larger the number of preliminary green compacts is, the better DC superposition characteristics tend to improve.

Second Embodiment

Hereinafter, Second Embodiment is described using FIG. 4 and FIG. 5, but is not described with respect to common matters with First Embodiment.

Figure 4:
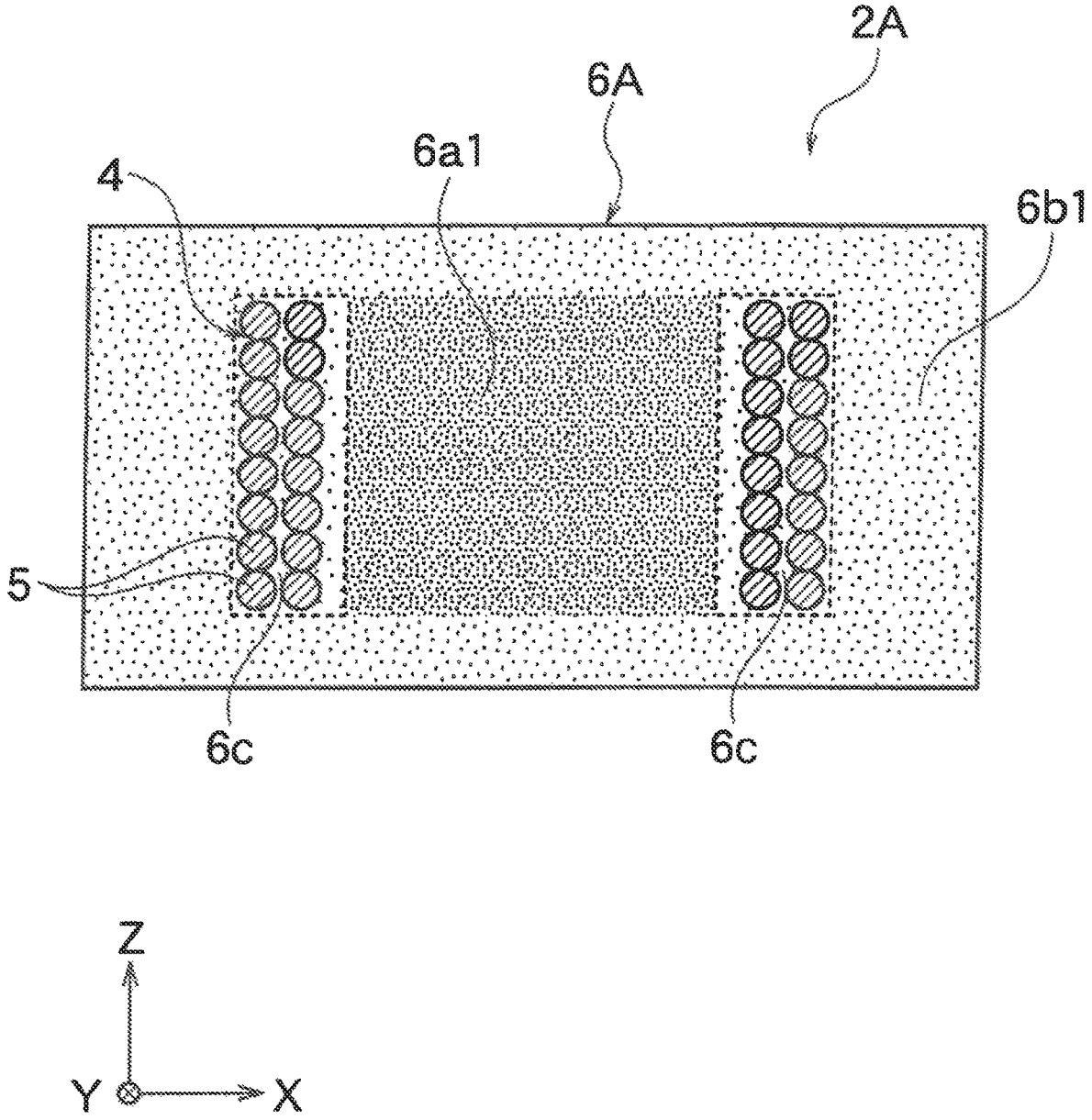
FIG. 4 is a cross-sectional view of an inductor element according to Second Embodiment of the present invention.

In an inductor element 2A of Second Embodiment shown in FIG. 4, the density of the magnetic powder in an inner core part 6*a*1 including the inner-core central region 6*a* and the winding-wire inner circumferential neighboring region 6β1 is higher than that of First Embodiment. In this case, the area ratio Sa of the magnetic powder in the inner-core central region 6α and the area ratio Sβ1 of the magnetic powder in the winding-wire inner circumferential neighboring region 6β1 tend to be high, and DC superposition characteristics tend to further improve compared to First Embodiment.

The inductor element 2A of Second Embodiment is manufactured by any method, and is manufactured by, for example, a method of preparing a preliminary green compact 60*a*1 where an inner core part 6*a*1α is higher than an outer circumference 6*b*1α by "z1" and similarly preparing a preliminary green compact 60*b*1 where an inner core part 6*a*1β is higher than an outer circumference 6*b*1β by "z2".

When a main compression similar to First Embodiment is carried out using the preliminary green compacts 60*a*1 and 60*b*1, the amount of the magnetic powder in the inner core part 6*a*1α is larger than the amount of the magnetic powder in the outer circumference 6*b*1α, and the density of the magnetic powder in the inner core part 6*a*1α (the inner-core central region 6*a* and the winding-wire inner circumferential neighboring region 6β1) is larger than the density of the magnetic powder in the outer circumference 6*b*1α containing the first end-surface neighboring region 6β2 and the second end-surface neighboring region 6β3.

Incidentally, there is no limit to the magnitude correlation of "z1" and "z2". That is, z1>z2 or z1<z2 may be satisfied. Moreover, "z1" or "z2" may be zero.

Figure 5:
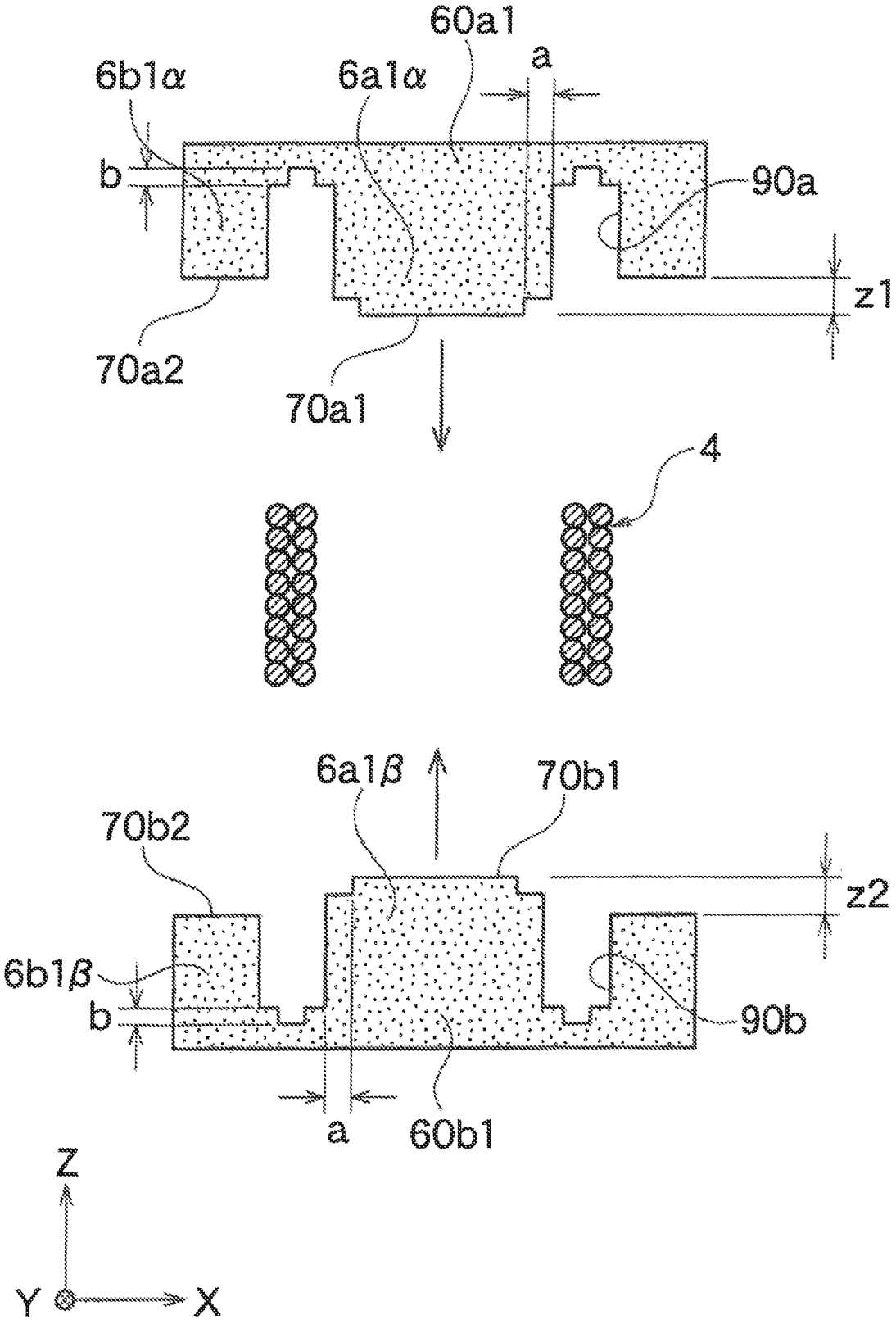
FIG. 5 is a cross-sectional view showing a method of manufacturing the inductor element shown in FIG. 4.

The lengths of the inner circumferential parts 6*a*1α and 6*a*1β in the Z-axis direction are larger than the lengths of the outer circumferences 6*b*1α and 6*b*1β in the Z-axis direction as shown in FIG. 5, and the inner core part 6*a*1 shown in FIG. 4 is thereby compressed more strongly than the outer circumference 6*b*1.

Even if a preliminary green compact having the shape shown in FIG. 7 is used, when the magnetic powder of the preliminary green compact to be an inner core part after a main compression has a high density, an inner core part of an inductor element to be finally obtained has a high density, and effects similar to the above are demonstrated.

Incidentally, the present invention is not limited to the above-mentioned embodiments and may be changed variously within the scope of the present invention.

EXAMPLES

Hereinafter, the present invention is described based on more detailed Examples, but is not limited thereto.

Example 1

In Example 1, preliminary green compacts having the shapes in FIG. 2 and FIG. 3 were manufactured by preliminary compression and were then subjected to a main compression, and an inductor element having the shape shown in FIG. 1 was obtained. Incidentally, a=0.20 mm and b=0.40 mm were satisfied.

First, granules to be filled in a die cavity were prepared. A Fe—Si alloy (average particle size: 25 μm) was prepared as a magnetic powder, and an insulating film of $SiO_2$ by sol-gel method was formed on the surface of the magnetic powder. The magnetic powder was added with 3 wt % of an epoxy resin diluted into acetone with respect to 100 wt % of the magnetic powder and was stirred. After the stirring, the stirred material was passed through a mesh whose size was 250 μm and dried at room temperature for 24 hours, and the granules to be filled in a die cavity were obtained.

The granules were filled in a die cavity and subjected to a preliminary compression, and the preliminary green compacts having the shapes in FIG. 2 and FIG. 3 were manufactured. The pressure during the preliminary compression was 400 MPa.

Next, the manufactured preliminary green compacts and an insert member were arranged in another die cavity that was different from the die used in the preliminary compression. The two preliminary green compacts shown in FIG. 2 and FIG. 3 and an insert member having a winding-wire portion whose inner diameter was 4 mm and height was 3 mm were arranged in the cavity as shown in FIG. 2 and FIG. 3.

Next, a main compression was carried out by pressurization from top and bottom in the Z-axis direction in FIG. 3. The main compression was carried out at 100 MPa.

Thereafter, the green compacts were taken out from the die and heated for 1 hour at 180° C., which was higher than the temperature (110° C.) where the epoxy resin began to be hardened, and the epoxy resin was hardened, whereby samples (sample numbers 1 to 3) of inductor elements of each example shown in Table 1 were obtained. The size of the obtained core portion was length 7 mm×width 7 mm×height 5.4 mm.

Measured were Sα, Sβ1, Sβ2, and Sβ3 of the samples of the inductor elements thus obtained. Specifically, Sα, Sβ1, Sβ2, and Sβ3 were calculated by observation of a SEM image of 480 m×560 m at each measurement point of the cross section of the inductor element. As for Sα, an inner-core central region was divided into six sections in parallel to the winding axis center, and one measurement point was set in each of the six sections (six measurement points in total). As for Sβ1, a winding-wire inner circumferential neighboring region was divided into six sections in parallel to the winding axis center, and one measurement point was set in each of the six sections (six measurement points in total). As for Sβ2 and Sβ3, one measurement point was set in each neighboring region. Then, Sα, Sβ1, Sβ2, and Sβ3 were calculated by calculating and averaging the area ratios of the magnetic powder at each of the measurement points, and Sβ4 was further calculated by averaging Sβ2 and Sβ3. Table 1 shows Sα, Sβ1, Sβ2, Sβ3, Sα−Sβ1, and Sα−Sβ4 in addition to the area ratio of the magnetic power at each measurement point.

Moreover, evaluated was crack generation of the samples of each inductor element. Moreover, inductance $L_0$ and DC superposition characteristics were measured. Table 2 shows the results.

Inductance $L_0$ was measured using an LCR meter (manufactured by Hewlett-Packard Co., Ltd.). In this measurement, the measurement frequency was 100 KHz, and the measurement voltage was 0.5 mV. An inductance $L_0$ of 37.6 to 56.4 μH was considered to be good.

In the measurement of DC superposition characteristics, DC current was applied from zero to the samples of each inductor element, and DC superposition characteristics were evaluated by Isat (A), which was determined as a current value (ampere) that flowed when inductance (μH) was decreased to 70% of inductance at zero current. When Isat was 3.6 A or more, DC superposition characteristics were considered to be good. When Isat was 5.0 A or more, DC superposition characteristics were considered to be better.

In the evaluation of crack generation, the samples of each inductor element were left for 500 hours in a high temperature and high humidity of 85° C. and 85% RH and thereafter applied with DC current from zero, and Icr (A) was determined as a current value at the generation of cracks.

When Icr-Isat>0 A was satisfied, crack prevention effect was considered to be good. When Icr-Isat>1.0 A was satisfied, crack prevention effect was considered to be better. In the cells of crack evaluation of Table 2, ○ is put when Icr-Isat>1.0 A was satisfied, Δ is put when 0 A<Icr-Isat≤1.0 A was satisfied, and × is put when Icr-Isat≤0 A was satisfied.

Figure 9:
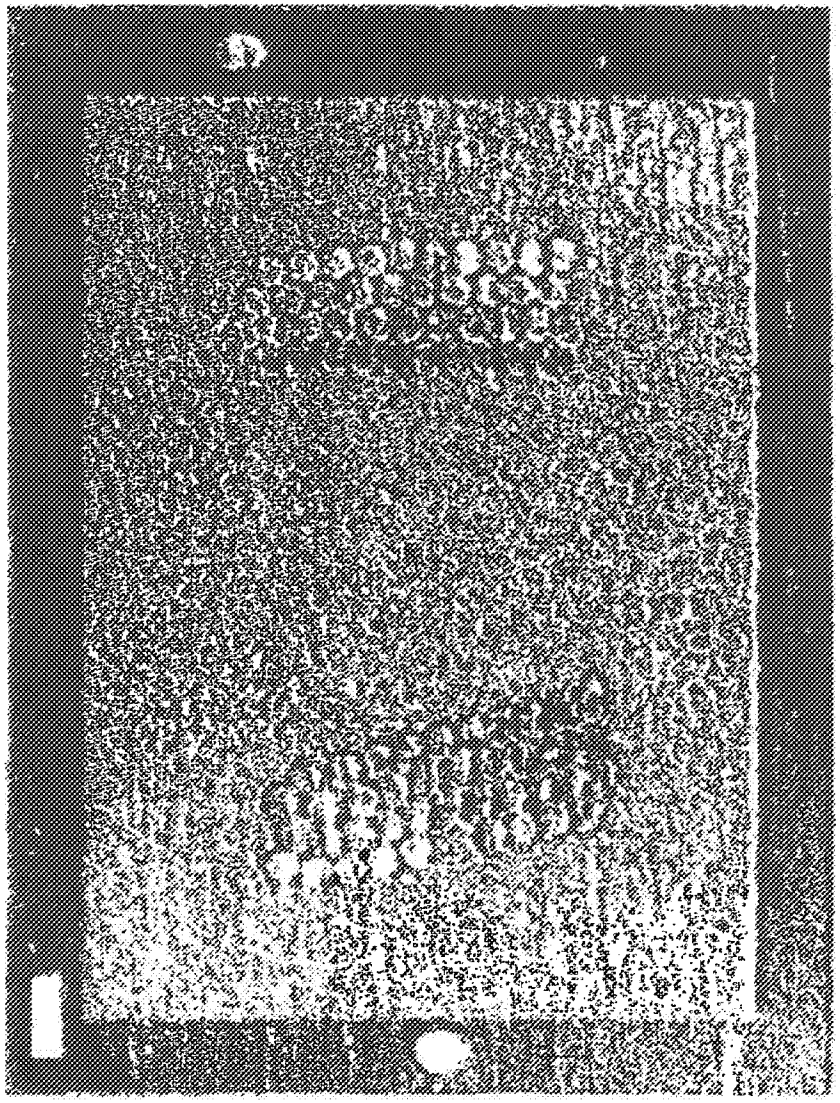
FIG. 9 is a cross-sectional photograph of the inductor element of Comparative Example 1 of the present application.
Figure 12:
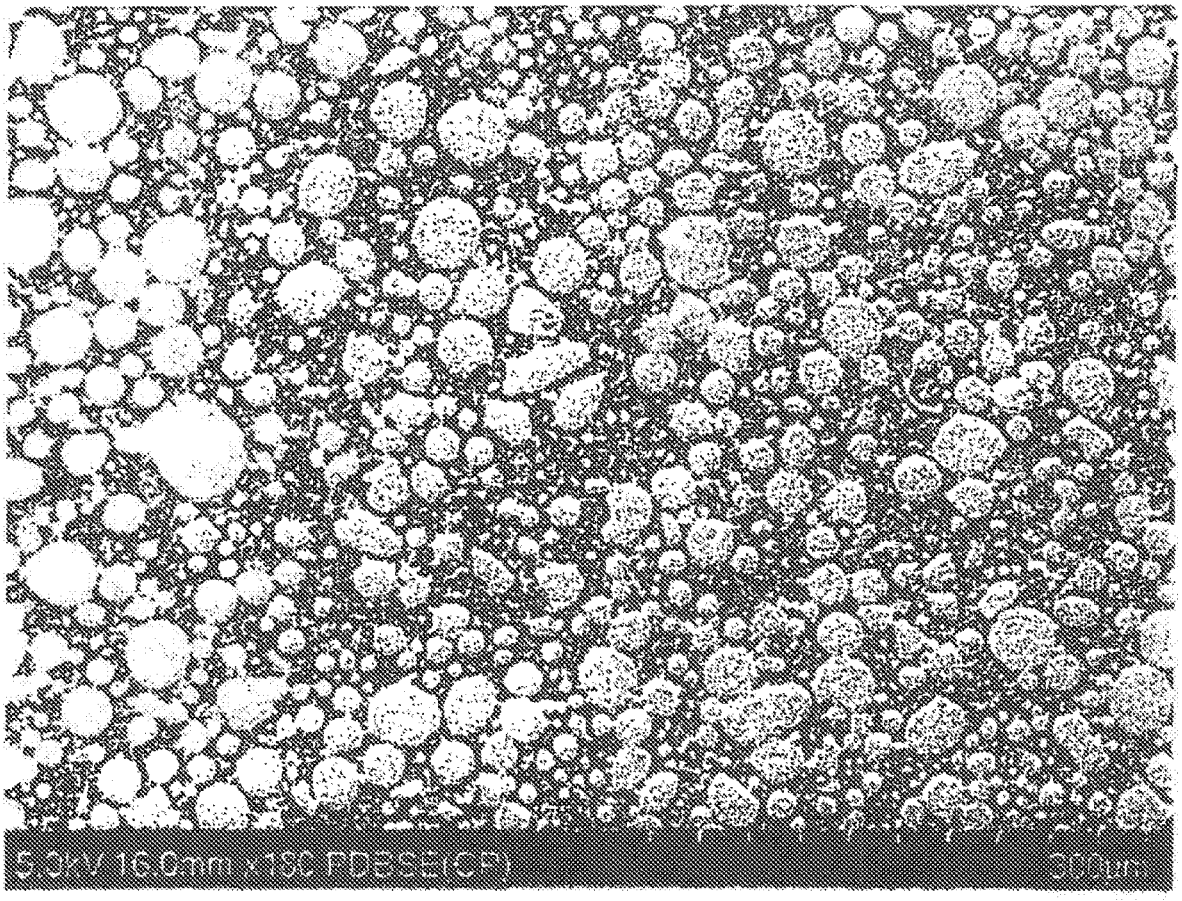
FIG. 12 is a SEM image of an inner-core central region of Example 1 of the present application.

Moreover, a cross sectional photograph of the sample of the inductor element of Example 1 was taken and shown in FIG. 9. Moreover, FIG. 12 shows a SEM image of the inner-core central region of Example 1.

Comparative Example 1

Figure 13:
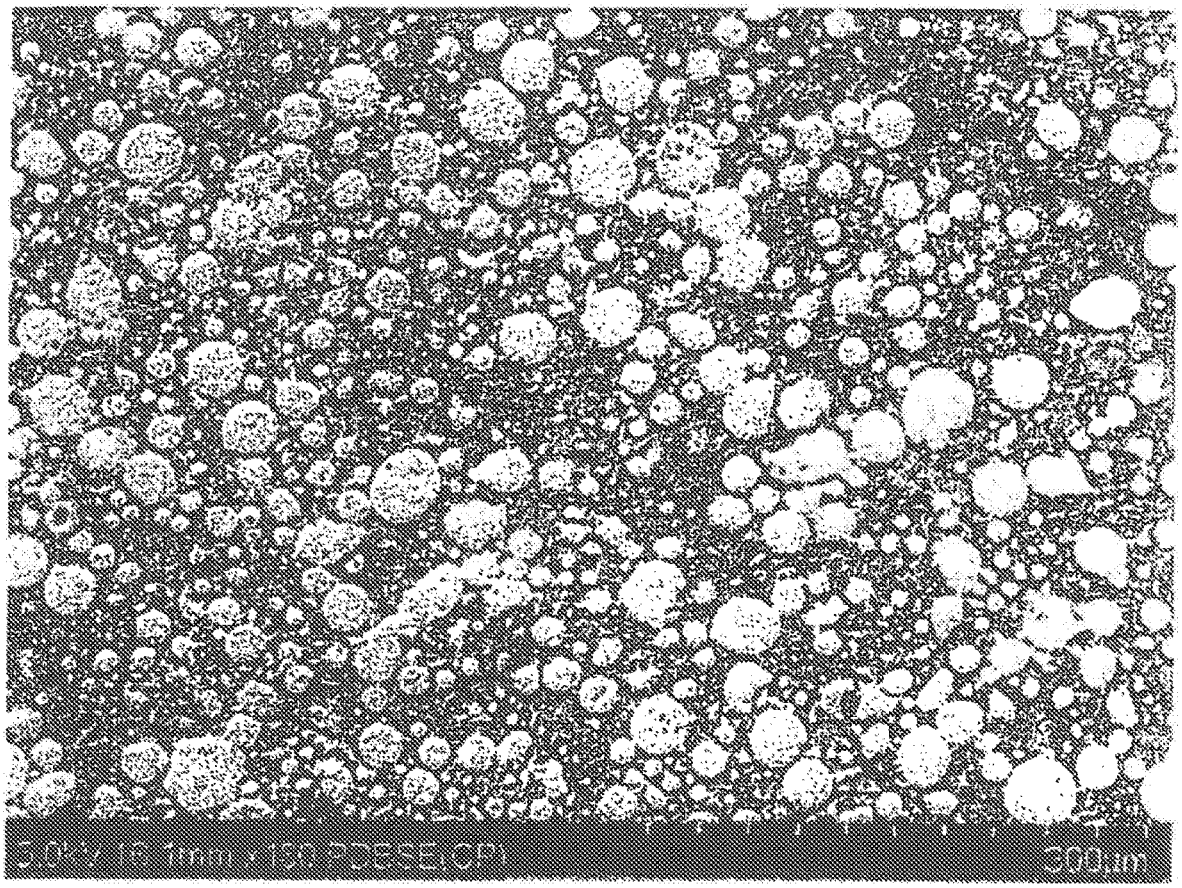
FIG. 13 is a SEM image of an inner-core central region of Comparative Example 1 of the present application.

In Comparative Example 1, granules were manufactured similarly to Example 1, an insert member was disposed in a die cavity for main compression, the granules were filled in the die cavity, and a main compression was carried out without preliminary compression. An inductor element of Comparative Example 1 was manufactured similarly to that of Example 1 except that the main compression was carried out without preliminary compression. Table 1 and Table 2 show the results. In Comparative Example 1, however, the air-core coil was deformed as no preliminary compression was carried out, and unlike Example 1, the density in a winding-wire inner circumferential neighboring region of the inductor element could not thereby be measured at six points. Thus, five measurement points were determined for the density in the winding-wire inner circumferential neighboring region. Moreover, FIG. 13 shows a SEM image of the inner-core central region of the inductor element of Comparative Example 1.

Moreover, a cross-sectional photograph of the sample of the inductor element of Comparative Example 1 was taken and shown in FIG. 9.

TABLE 1

| | area ratio of metal powder [%] | | | | | | | | | | | | | | | |
|---|---|---|---|---|---|---|---|---|---|---|---|---|---|---|---|---|
| | winding-wire inner circumferential neighboring region | | | | | | | core central region | | | | | | | first end-surface neighboring | second end-surface neighboring |
| | 1 | 2 | 3 | 4 | 5 | 6 | average (Sβ1) | 1 | 2 | 3 | 4 | 5 | 6 | average (Sα) | region (Sβ2) | region (Sβ3) |
| EX. 1 | 65.4 | 65.7 | 63.9 | 64.8 | 65.4 | 63.1 | 64.7 | 71.5 | 74.6 | 71.5 | 72.1 | 69.8 | 71.4 | 71.8 | 64.5 | 66.2 |
| COMP. EX1 | 59.7 | 57.6 | 53.5 | 52.0 | 59.5 | | 56.5 | 61.1 | 59.5 | 59.4 | 60.9 | 55.7 | 55.6 | 58.7 | 64.5 | 62.9 |

TABLE 2

| | shape of preliminary green compact | composition of metal powder | preliminary compression | a [mm] | b [mm] | z1 [mm] | area ratio of metal powder [%] Sα | Sβ1 | Sβ2 | Sβ3 | Sα − Sβ1 | Sα − Sβ4 | $L_0$ [pH] | Isat [A] | Icr [A] | crack evaluation |
|---|---|---|---|---|---|---|---|---|---|---|---|---|---|---|---|---|
| EX. 1 | FIGS. 2 and 3 | Fe—Si | done | 0.20 | 0.40 | 0.00 | 3.5 | 3.5 | 64.5 | 66.2 | 0.0 | −61.9 | 48.00 | 6.45 | >8.0 | ○ |
| EX. 2 | FIGS. 2 and 3 | Fe—Si | done | 0.15 | 0.20 | 0.00 | 72.1 | 65.7 | 68.8 | 69.3 | 6.4 | 3.1 | 48.52 | 6.29 | >8.0 | ○ |
| EX. 3 | FIGS. 2 and 3 | Fe—Si | done | 0.10 | 0.05 | 0.00 | 71.9 | 66.1 | 73.0 | 73.0 | 5.8 | −1.1 | 49.04 | 6.10 | 7.4 | ○ |
| EX. 4 | FIGS. 2 and 3 | Fe—Si | done | 0.05 | 0.00 | 0.00 | 64.2 | 58.8 | 67.3 | 66.8 | 5.4 | −2.8 | 47.59 | 6.21 | 6.9 | Δ |
| EX. 5 | FIGS. 2 and 3 | Fe—Si | done | 0.15 | 0.30 | 0.00 | 64.8 | 58.3 | 58.7 | 59.1 | 6.5 | 5.9 | 47.43 | 6.12 | >8.0 | ○ |
| COMP. EX1 | no preliminary green compact | Fe—Si | no | — | — | — | 71.8 | 64.7 | 64.5 | 62.9 | 7.1 | 8.1 | 46.39 | 4.94 | <4.0 | x |
| EX. 11 | FIGS. 2 and 3 | Fe—Si—Cr | done | 0.15 | 0.40 | 0.00 | 71.3 | 64.9 | 65.2 | 64.6 | 6.4 | 6.4 | 49.02 | 5.26 | >8.0 | ○ |
| COMP. EX11 | no preliminary green compact | Fe—Si—Cr | no | — | — | — | 57.6 | 55.0 | 63.0 | 63.0 | 2.6 | −5.4 | 47.48 | 4.06 | <4.0 | x |
| EX. 21 | FIG. 5 | Fe—Si | done | 0.15 | 0.40 | 0.80 | 73.4 | 67.1 | 65.6 | 66.2 | 6.3 | 7.5 | 48.70 | 6.70 | >8.0 | ○ |

Figure 8:
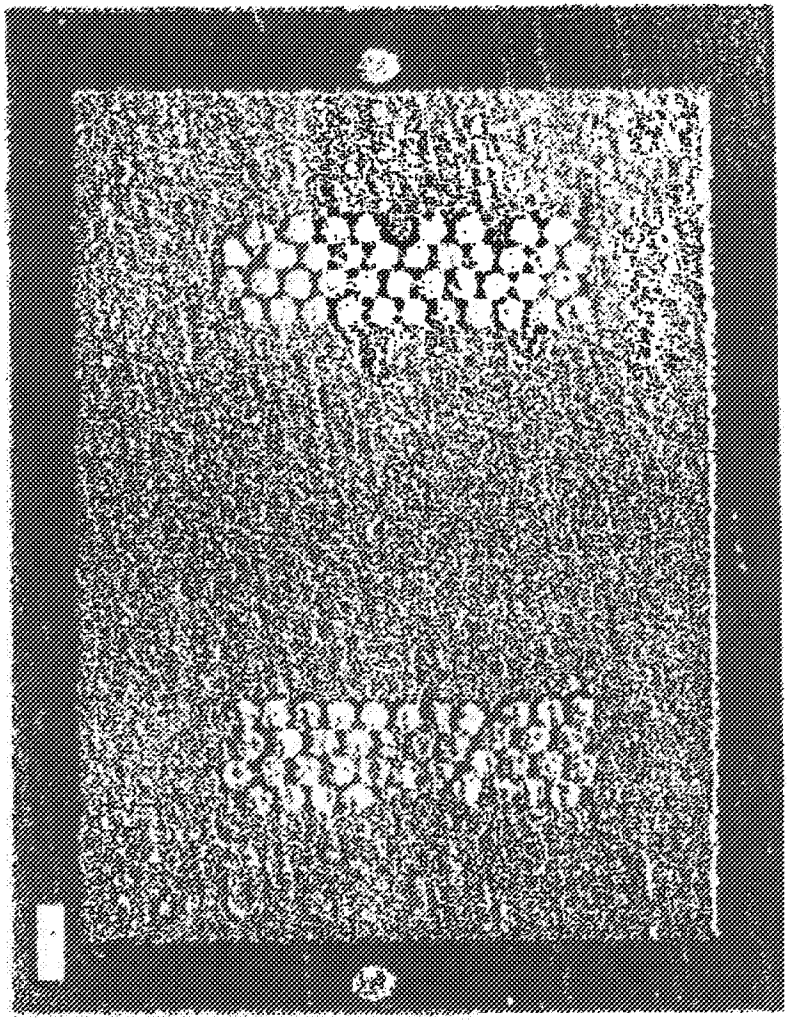
FIG. 8 is a cross-sectional photograph of the inductor element of Example 1 of the present application.

According to Table 1, FIG. 12, and FIG. 13, the density of the inner-core central region was higher than the density of the winding-wire inner circumferential neighboring region in Example 1 of the present application. Moreover, the density of the inner-core central region was higher than the density of the first end-surface neighboring region and the density of the second end-surface neighboring region. On the other hand, the density of the winding-wire inner circumferential neighboring region and the density of the inner-core central region were substantially equal to each other in Comparative Example 1 of the present application. Moreover, the density of the inner-core central region was lower than the first end-surface neighboring region and the density of the second end-surface neighboring region in Comparative Example 1 of the present application. Moreover, when FIG. 8 and FIG. 9 were compared, the inductor element of Example 1 of the present application had a smaller distortion than the inductor element of Comparative Example 1 of the present application.

According to Table 1 and Table 2, it is understood that the area ratio of the magnetic powder in particularly the winding-wire inner circumferential neighboring region had a small variation in the inductor element of Example 1 of the present application. That is, the inductor element of Example 1 of the present application had a small variation with respect to the density of the magnetic powder in the winding-wire inner circumferential neighboring region and to characteristics.

Moreover, Table 1 and Table 2 show that Example 1 of the present application, where Sα−Sβ1 was 5.0% or more, had a larger effect on crack prevention than Comparative Example 1 of the present application, where Sα−Sβ1 was less than 5.0%. Example 1 of the present application, where Sα−Sβ4 was 5.0% or more, was more excellent than Comparative Example 1 of the present application, where Sα−Sβ4 was less than −2.0%, with respect to, for example, inductance change rate before and after the high-temperature storage test at 150° C. The inductance change rate of Example 1 of the present application was small probably because the density around the coil was low, and the distortion of the coil was small. Moreover, Example 1 of the present application, where Sa was 65% or more, had a higher Isat and more excellent DC superposition characteristics than those of Comparative Example 1 of the present application, where Sa was less than 65%.

Examples 2 to 5

Examples 2 to 5 were examples where "a" and "b" were changed from those of Example 1, and Sα, Sβ1, Sβ2, Sβ3, and Sβ4 were changed by controlling the material filling rate in a range where Sα−Sβ1 was 5.0% or more.

Specifically, "a" and "b" of Examples 2 and 3 were smaller than those of Example 1. In Examples 4 and 5, "a" and "b" were smaller than those of Example 1, and the filling rate of granules was reduced. Table 2 shows the results. In all of Examples 2 to 5, Sα−Sβ1 was 5.0% or more, and the effect on crack prevention was large.

Examples 1 to 3 and 5, where Sα−Sβ4≥−2.0% was satisfied, had a larger effect on crack prevention than that of Example 4, where Sα−Sβ4<−2.0% was satisfied. Moreover, Examples 1, 2, and 5, where Sα−Sβ4≥0% was satisfied, had a further larger effect on crack prevention than that of Example 3, where Sα−Sβ4<0% was satisfied.

Example 11 and Comparative Example 11

Figure 10:
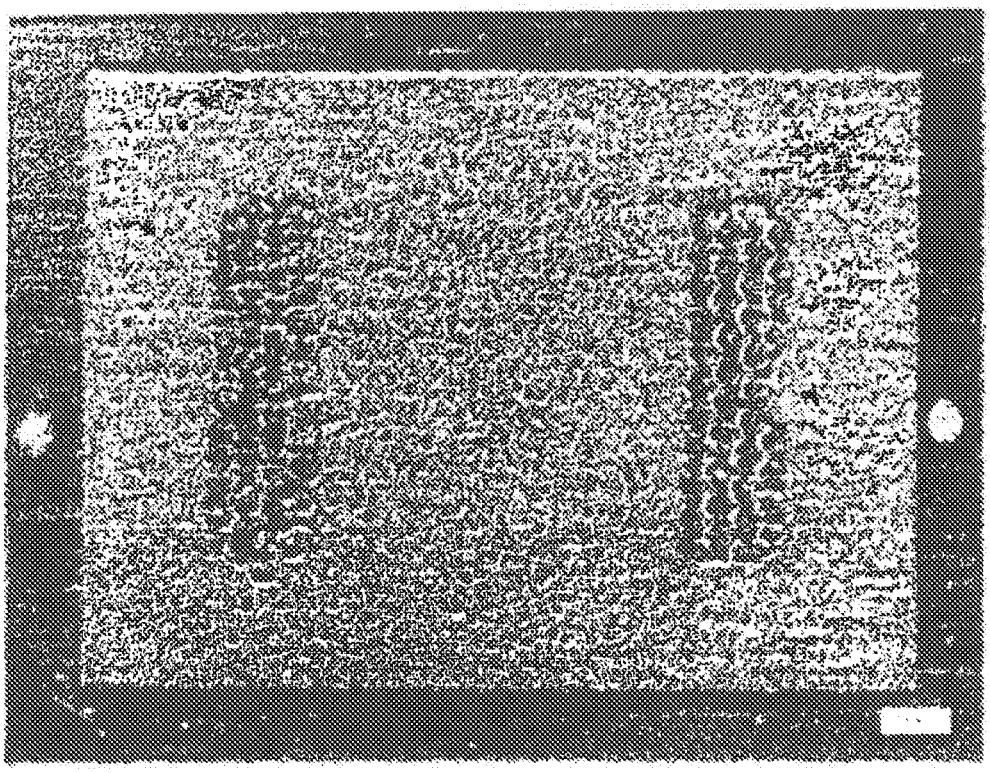
FIG. 10 is a cross-sectional photograph of the inductor element of Example 11 of the present application.
Figure 11:
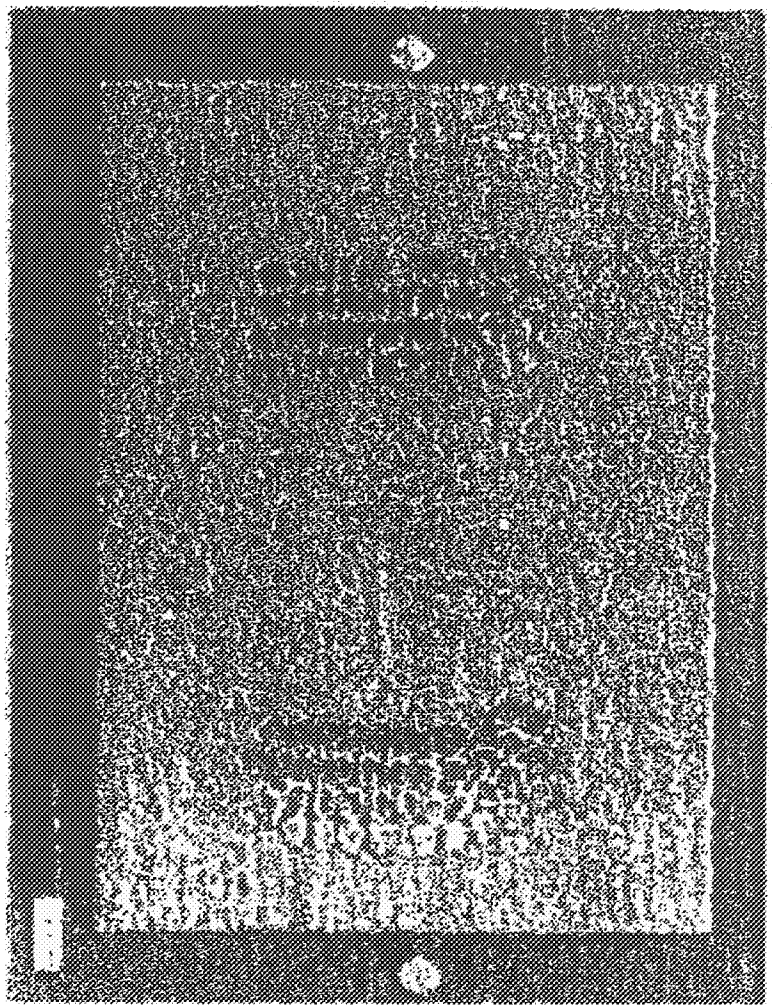
FIG. 11 is a cross-sectional photograph of the inductor element of Comparative Example 11 of the present application.
Figure 14:
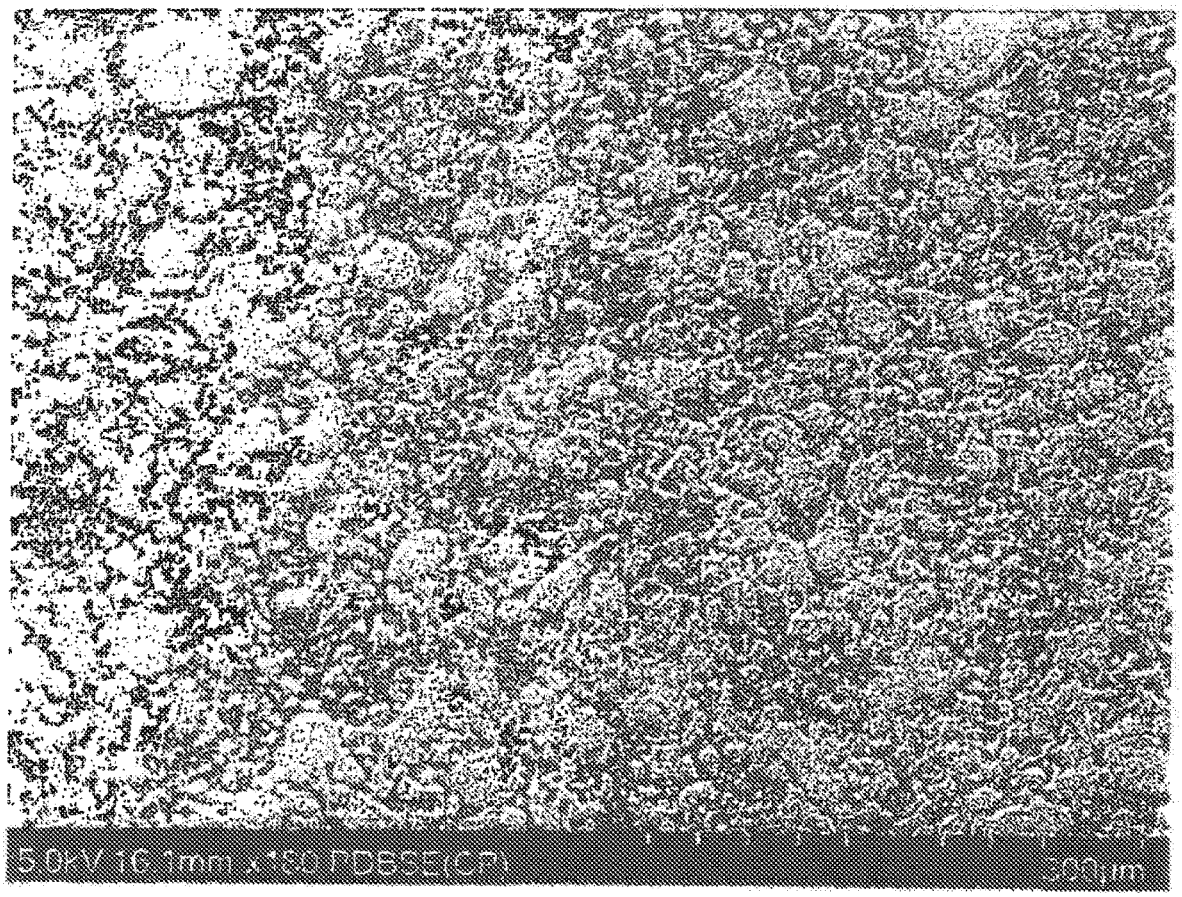
FIG. 14 is a SEM image of an inner-core central region of Example 11 of the present application.
Figure 15:
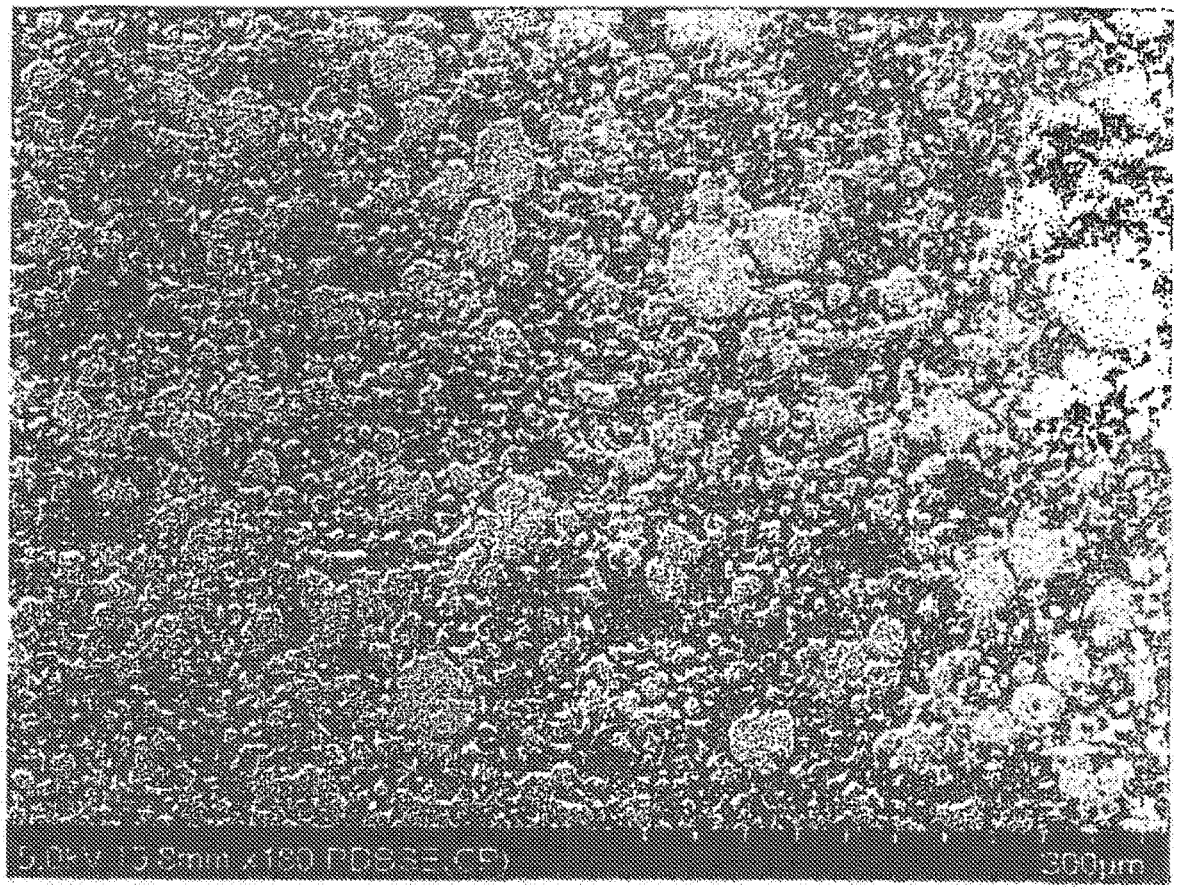
FIG. 15 is a SEM image of an inner-core central region of Comparative Example 11 of the present application.

Example 11 and Comparative Example 11 were respectively manufactured with the same conditions as Example 1 and Comparative Example 1 except that a Fe—Si—Cr alloy (average particle size: 25 μm) was prepared as a magnetic powder. Table 2 shows the results. A cross-sectional photograph of the sample of the inductor element of Example 11 was taken and shown in FIG. 10. A cross-sectional photograph of the sample of the inductor element of Comparative Example 11 was taken and shown in FIG. 11. Moreover, FIG. 14 shows a SEM image of the inner-core central region of Example 11, and FIG. 15 shows a SEM image of the inner-core central region of Comparative Example 11.

Example 11 and Comparative Example 11 show that a similar tendency to the tendency of the magnetic powder of Fe—Si alloy was exhibited even in the magnetic powder of Fe—Si—Cr alloy.

Example 21

The inductor element of Example 21 was manufactured with the same conditions as those of Example 1 except that the shape of the preliminary green compact was changed to the shape shown in FIG. 5. Incidentally, z1=z2=800 Lm was satisfied. Table 2 shows the results.

According to Table 2, Sα, Sβ1, and Sα−Sβ4 of Example 21, where the shape of the preliminary green compact was the shape shown in FIG. 5, were further larger than those of Example 1. As a result, DC superposition characteristics of Example 21 was further improved.

NUMERICAL REFERENCES

2,2A . . . inductor element
4 . . . winding-wire portion
4*a* . . . winding axis center
4β1 . . . inner circumferential surface
4β2 . . . first end surface
4β3 . . . second end surface
4β4 . . . outer circumferential surface
5 . . . conductor
6 . . . core portion
6*a* . . . inner circumferential part
6*b* . . . outer circumferential part
6α . . . inner-core central region
6β1 . . . winding-wire inner circumferential neighboring region
6β2 . . . first end-surface neighboring region
6β3 . . . second end-surface neighboring region
60*a* to 60*k* . . . preliminary green compact
70*a* to 70*n* . . . joint projected surface
80 . . . leading groove
90*a*, 90*b* . . . housing concave portion

The invention claimed is:

1. An inductor element, comprising:

a wire-winding portion where a conductor is wound in a coil shape; and a core portion surrounding the wire-winding portion and containing a magnetic powder and a resin, wherein the wire-winding portion comprises an inner circumferential surface, an outer circumferential surface, and a first end surface and a second end surface opposite to each other in a winding axis center of the wire-winding portion, wherein a winding-wire inner circumferential neighboring region is defined as a region of the core portion within a predetermined distance from the inner circumferential surface toward the winding axis center, wherein a winding-wire first end-surface neighboring region is defined as a region of the core portion within a predetermined distance from the first end surface toward an outward direction parallel to the winding axis center, wherein a winding-wire second end-surface neighboring region is defined as a region of the core portion within a predetermined distance from the second end surface toward the outward direction, wherein an inner-core central region is defined as a region of the core portion within a predetermined distance from the winding axis center toward an existing region of the wire-winding portion in an outward direction perpendicular to the winding axis center, wherein the winding-wire inner circumferential neighboring region, the winding-wire first end-surface neighboring region, the winding-wire second end-surface neighboring region, and the inner-core central region respectively contain the magnetic powder and the resin, and wherein Sα−Sβ1≥5.0% is satisfied, where Sα (%) is a ratio of an area occupied by the magnetic powder in the inner-core central region, and Sβ1(%) is a ratio of an area occupied by the magnetic powder in the winding-wire inner circumferential neighboring region, on a cross section of the inductor element passing the winding axis center and parallel thereto.

2. The inductor element according to claim 1, wherein Sα−Sβ4≥−2.0% is satisfied, where Sβ4(%) is an average of Sβ2 and Sβ3, where Sβ2(%) is a ratio of an area occupied by the magnetic powder in the winding-wire first end-surface neighboring region, and Sβ3(%) is a ratio of an area occupied by the magnetic powder in the winding-wire second end-surface neighboring region, on the cross section of the inductor element.

3. The inductor element according to claim 2, wherein Sα−Sβ4≥0% is satisfied.

4. The inductor element according to claim 3, wherein Sα−Sβ4≥5.0% is satisfied.

5. The inductor element according to claim 1, wherein Sα≥65% is satisfied.

6. The inductor element according to claim 2, wherein Sα≥65% is satisfied.

7. The inductor element according to claim 3, wherein Sα≥65% is satisfied.

8. The inductor element according to claim 4, wherein Sα65% is satisfied.

9. The inductor element according to claim 1, wherein Sβ1≥60% is satisfied.

10. The inductor element according to claim 2, wherein Sβ1≥60% is satisfied.

11. The inductor element according to claim 3, wherein Sβ1≥60% is satisfied.

12. The inductor element according to claim 4, wherein Sβ1≥60% is satisfied.

13. The inductor element according to claim 5, wherein Sβ1≥60% is satisfied.

14. The inductor element according to claim 1, wherein Sβ4≥60% is satisfied, where Sβ4(%) is an average of Sβ2 and Sβ3, where Sβ2(%) is a ratio of an area occupied by the magnetic powder in the winding-wire first end-surface neighboring region, and Sβ3(%) is a ratio of an area occupied by the magnetic powder in the winding-wire second end-surface neighboring region, on the cross section of the inductor element.

15. The inductor element according to claim 2, wherein Sβ4≥60% is satisfied.

16. The inductor element according to claim 3, wherein Sβ4≥60% is satisfied.

17. The inductor element according to claim 4, wherein Sβ4≥60% is satisfied.

18. The inductor element according to claim 5, wherein Sβ4≥60% is satisfied, where Sβ4(%) is an average of Sβ2 and Sβ3, where Sβ2(%) is a ratio of an area occupied by the magnetic powder in the winding-wire first end-surface neighboring region, and Sβ3(%) is a ratio of an area occupied by the magnetic powder in the winding-wire second end-surface neighboring region, on the cross section of the inductor element.

19. The inductor element according to claim 9, wherein Sβ4≥60% is satisfied, where Sβ4(%) is an average of Sβ2 and Sβ3, where Sβ2(%) is a ratio of an area occupied by the magnetic powder in the winding-wire first end-surface neighboring region, and Sβ3(%) is a ratio of an area occupied by the magnetic powder in the winding-wire second end-surface neighboring region, on the cross section of the inductor element.

* * * * *